United States Patent [19]

Boggess et al.

[11] Patent Number: 4,805,331

[45] Date of Patent: Feb. 21, 1989

[54] PIVOTABLE DISPLAY AND DISPENSING APPARATUS

[75] Inventors: Charles H. Boggess, Tualatin, Oreg.; Richard G. Krautsack, Arlington Heights, Ill.

[73] Assignee: Comark Merchandising, Inc., Elk Grove Village, Ill.

[21] Appl. No.: 925,320

[22] Filed: Oct. 31, 1986

Related U.S. Application Data

[63] Continuation-in-part of Ser. No. 819,855, Jan. 10, 1982, abandoned.

[51] Int. Cl.[4] ..... G09F 3/20

[52] U.S. Cl. ..... 40/651; 40/608; 40/611; 211/59.2

[58] Field of Search ..... 40/608, 613, 602, 16.2, 40/16.4, 16.6, 611, 490, 124.2; 221/281; 211/50, 59.2

[56] References Cited

U.S. PATENT DOCUMENTS

| | | | |
|---|---|---|---|
| 851,012 | 4/1907 | Lanius | 40/613 |
| 1,532,865 | 4/1925 | Beck | 40/608 |
| 2,787,433 | 4/1957 | Slavsky et al. | 40/16.4 |
| 2,921,393 | 1/1960 | Wood | 40/11 |
| 2,923,078 | 2/1960 | Slavsky | 40/16.4 |
| 3,008,254 | 11/1961 | Smith | 40/16.6 |
| 3,014,294 | 12/1961 | Singer | 40/5 |
| 3,015,897 | 1/1962 | Hopp | 40/16.2 |
| 3,102,351 | 9/1963 | Howell | 40/611 |

*Primary Examiner*—Robert P. Swiatek
*Assistant Examiner*—Cary E. Stone
*Attorney, Agent, or Firm*—Fitch, Even, Tabin & Flannery

[57] ABSTRACT

Apparatus for either display, or for both display and dispensing, is mounted to shelf tag molding directs customer attention to a featured item in a store as customers approach the area of a shelf on which the item can be found. The apparatus comprises a frame that is pivotally mounted into a bracket assembly which is rigidly secured to the shelf tag molding. The frame holds on either side of its surfaces, promotional material that presents a message to the approaching customers. The apparatus includes biasing springs which position the frame in a steady state location that is normal to the shelf tag molding. Whenever the frame is deflected from its steady state location by, for example, a customer or a shopping cart moving past and striking it, the biasing springs automatically return the frame to its steady state location. This ensures that the advertising message appearing on the promotional materials continually remains in direct view of approaching customers. The display apparatus receives two advertising placards for presentation to approaching customers. The display and dispensing apparatus includes a removable top cover for bulk loading of promotional material within the apparatus. Finger-receiving openings formed adjacent the outer bottom corner of the frame facilitate dispensing of the outer sheet of promotional material to a customer.

18 Claims, 5 Drawing Sheets

PIVOTABLE DISPLAY AND DISPENSING APPARATUS

This is a continuation-in-part application of copending U.S. Ser. No. 819,855, filed Jan. 10, 1986, now abandoned.

BACKGROUND OF THE INVENTION

Field of Invention

The present invention relates to the display and also the dispensing of sales material such as refunds and rebates and, in particular, an apparatus for displaying and/or dispensing sales materials in a manner which attracts customers' attention to a featured item in the store as customers approach the area of a shelf on which the item can be found.

There exist arrangements within a store for promoting the sale of a featured item. For example, aisle displays and shopping cart advertising placards which usually do not contain refund and rebate materials, are routinely used to inform customers about products available for sale in the store.

Sales coupons or other messages announcing price discounts and other promotional information, such as recipes, instructions, and recommended uses of a product, sometimes appear on displays positioned near or on a shelf where the discounted or promotional item can be found. These messages appear either on signs mounted across the front of the shelf or on flexible material extending generally outwardly from the shelf toward the aisle.

A sign mounted across the front of the shelf is out of the direct view of approaching customers and thus is less effective than one visible from the time the customer enters the aisle. Signs made of flexible material extending outwardly from the shelf are typically held along a side margin of the shelf by a rigid bracket that is mounted thereto. A sign of this latter type cannot advantageously be positioned in the direct view of approaching customers because the rigid bracket must be of relatively short length to prevent the obstruction of the traffic pattern of shopping carts moving along with the aisle where the shelf is located. Not only are these signs easily removed by unauthorized individuals or susceptible to dislodging by customers moving past and inadvertently striking them, but also signs of this type are not readily amenable to the dispensing of promotional material for the featured item. Further, such flexible material bearing the advertising message must also be of relatively small dimensions to prevent obstructing access of customers and store clerks to items stocked on the shelf.

For the above reasons, the above-described display arrangements are suitable only for use as temporary fixtures on the shelf. This is disadvantageous if the continuous presence of an advertising message is to be guaranteed to a product supplier for specified time.

Also, product suppliers frequently offer short-term promotional campaigns in the form of discount refunds. These offers also function as advertising material announcing the presence of the item for sale. Conventionally, store refunds are located remote from the items offered for sale, typically in a service area of the store. The effectiveness of this arrangement as a sales tool is diminished, since the customer does not have ready access to the sales item and may have already concluded shopping in the particular store. Refunds and like promotional material would be made more effective if a quantity of the material was located immediately adjacent to the sales item, where the customer could obtain both the material and the sales item at the same time.

SUMMARY OF THE INVENTION

An object of the present invention is, therefore, to provide a method of directing customer attention to a featured item at a location on a shelf where the item can be found.

Another object of this invention is to provide a method for either displaying or for both displaying and dispensing sales refunds or like printed promotional material so that it remains continually in the direct view of approaching customers.

A further object of this invention is to provide apparatus that positions promotional material near the frontal margin of the shelf and in full view of approaching customers, but without impeding the customer traffic flow where the promotional material is located.

Still another object of this invention is to provide apparatus that is amenable for use as a semipermanent fixture on a sales shelf, to ensure the continuous presence of an advertising message or a series of advertising messages related to the particular sales space adjourning the apparatus.

Additional objects and advantages of the present invention will be apparent from the following detailed description of certain preferred embodiments thereof, which proceeds with reference to accompanying drawings.

BRIEF DESCRIPTION OF THE DRAWINGS

In the drawings, wherein like elements are referenced alike.

DETAILED DESCRIPTION OF THE PREFERRED EMBODIMENT

By way of introduction, the illustrated embodiments of the present invention are readily secured to a shelf on which the promoted product appears. The apparatus of the first embodiment, illustrated in FIGS. 1–6, retains promotional material such as advertising placards for presentation to shoppers approaching the apparatus from either direction. The second embodiment, illustrated in FIGS. 7–14 retains two quantities of plural sheets of promotional material, such as sales refunds or the like, for displaying the material to shoppers approaching from either direction, as in the first embodiment, but also presents these plural sheets of promotional material for dispensing to shoppers at the site where the promoted item is located.

Figure 1:
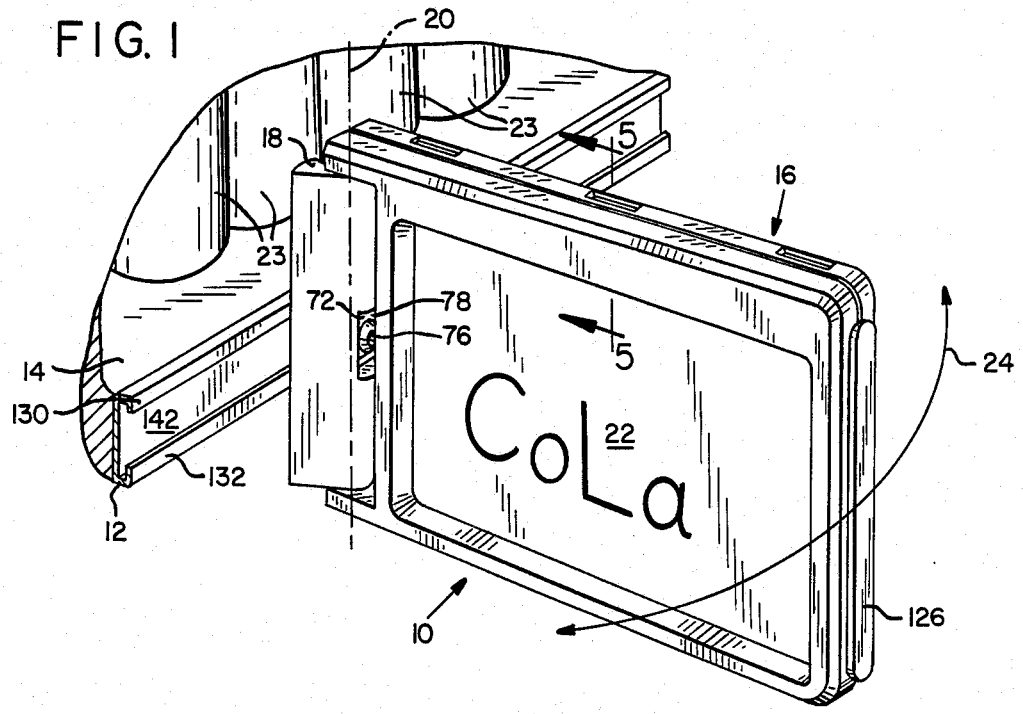
FIG. 1 is a fragmentary perspective view showing a first illustrative apparatus mounted to shelf tag molding on the frontal margin of a shelf, and displaying an advertising message placard that is positioned in direct view of approaching customers and which incorporates various features of the present invention.

With reference to FIG. 1, display apparatus 10 of the present invention is mounted to a strip of shelf tag molding 12 that is secured to the frontal margin of a shelf 14 in a store. Shelf tag molding is conventionally used to hold pieces of flexible plastic material on which price information appears.

Display apparatus 10 comprises a frame 16 that is pivotably mounted to bracket assembly 18, which is rigidly secured to shelf tag molding 12. Bracket 18 is positioned on a shelf tag molding 12 so that frame 16 pivotably moves about a vertical pivot axis 20. Frame 16 displays from either one of its surfaces, promotional material, such as advertising placards. As will be described in detailed below, display apparatus 10 includes a biasing means or spring which positions frame 16 in a steady state location that is generally normal or perpendicular to shelf tag molding 12. The steady state location positions the advertisement message of the promotional material in the direct view of customers approaching it from either direction along the store aisle.

The promotional material preferably calls a customer's attention to a product 23, which is shown in FIG. 1 as cans of cola, that can be found in the area on shelf 14 where display apparatus 10 is mounted. The underlying theory is that the promotional item will dominate at the moment of the customer's purchase decision. To satisfy this object, frame 16 necessarily projects into the path of a customer approaching it. Frame 16 is mounted to bracket 18 to pivotally move out of the way of a customer or shopping cart that strikes it. Whenever frame 16 is pivotally moved in a rotational sense along the arcuate path 24 as shown, the biasing means automatically returns frame 16 to its steady-state location. This ensures that the advertising message on the promotional material continually remains in direct view of approaching customers.

Figure 4:
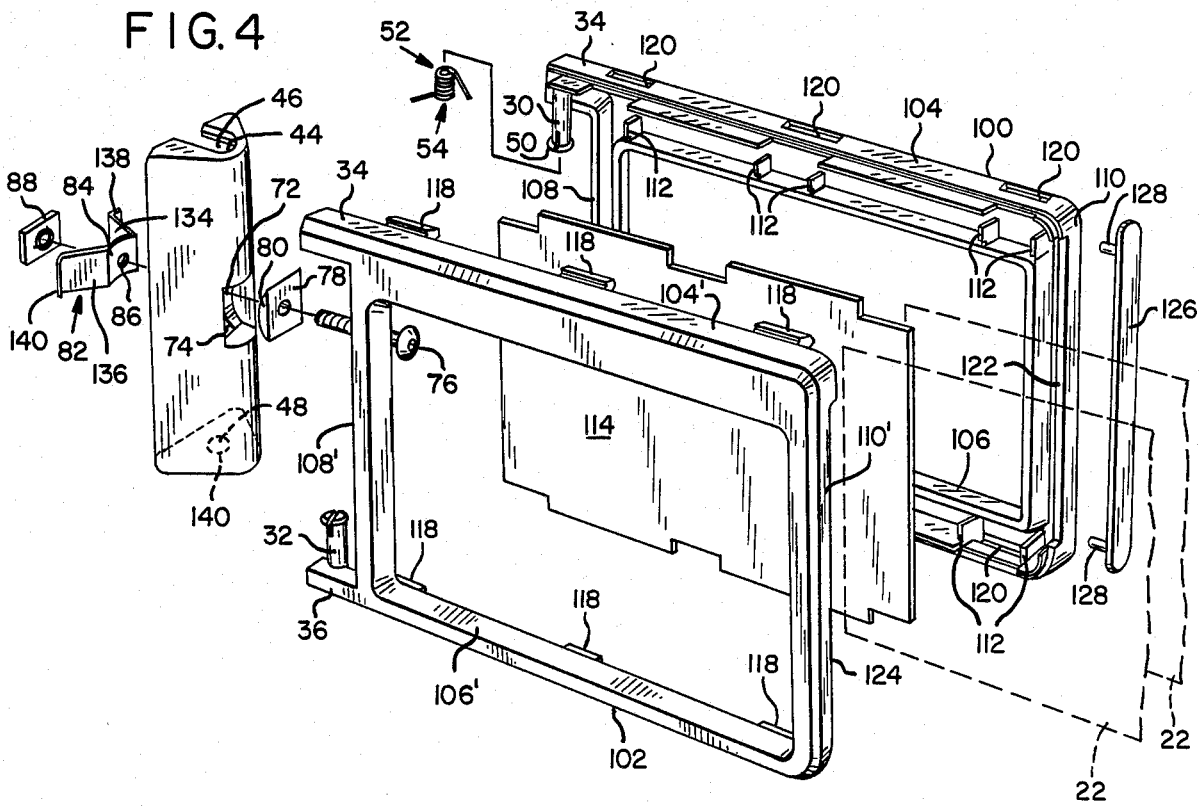
FIG. 4 is an exploded perspective view of the display apparatus of FIG. 1.
Figure 2:
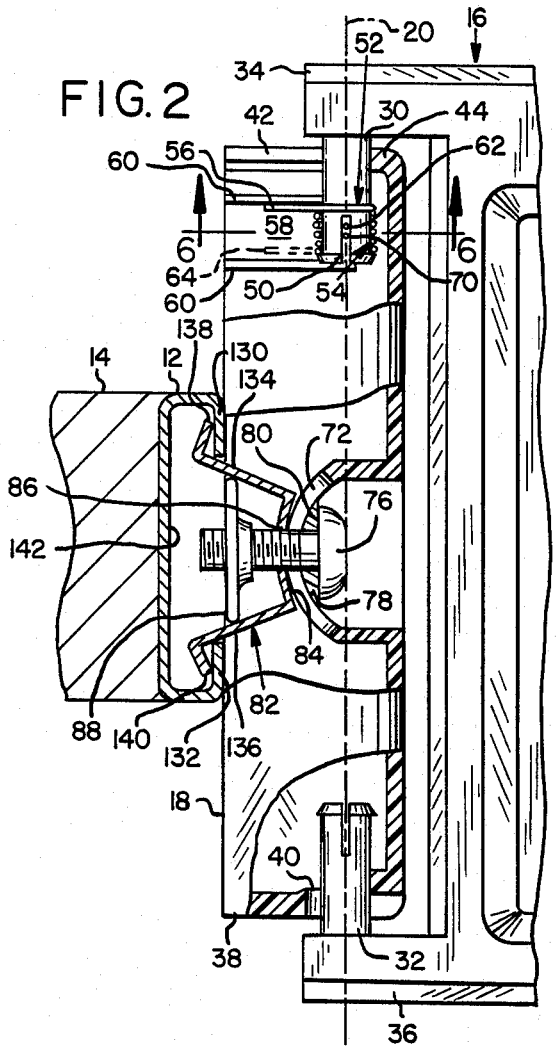
FIG. 2 is a fragmentary side elevational view of the display apparatus of FIG. 1 with portions cut away to show in detail the mounting bracket of the present invention.
Figure 3:
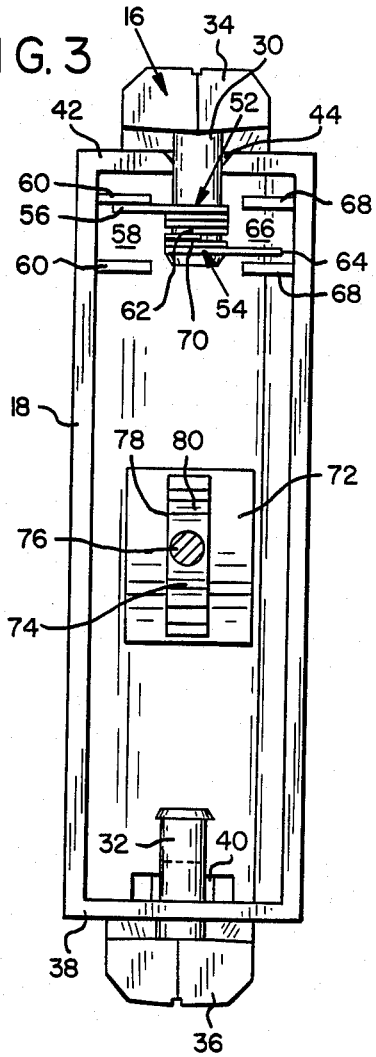
FIG. 3 is an end view of the interior of the mounting bracket with a portion shown in cross-section.

With reference to FIGS. 2–4, bracket 18 is mounted for relative pivotal movement about a first or upper stub shaft 30 and a second or lower stub shaft 32. Upper stub shaft 30 projects downwardly from the upper extension 34 of frame 16, and lower stub shaft 32 extends upwardly from the lower extension 36 of frame 16. Bracket 18 is generally of V-shaped cross section in the horizontal plane that is defined by shelf 14 in FIG. 1. The lower end 38 of bracket 18 has a hole 40 which receives lower stub shaft 32. The upper end 42 of bracket 18 has an open-ended elongated U-shaped slot 44 (FIG. 4) that receives upper stub shaft 30. A center 46 of the radius of curvature of slot 44 is axially aligned with the center of hole 40 to promote the pivotal movement of bracket 18 about stub shafts 30 and 32 relative to frame 16. The line connecting the centers defines pivot axis 20.

Bracket 18 is mounted to frame 16 by inserting stub shaft 32 into hole 40, orienting bracket 18 such that the sides of its U-shaped slot 44 are perpendicular to the surfaces of frame 16, and guiding stub shaft 30 into slot 44.

Upper stub shaft 30 has an opening or a thin slot 50 that extends along approximately one-third the length of the shaft from its free end and defines a plane that lies along pivot axis 20. Each one of a pair of coil springs 52 and 54 encircles at least a portion of stub shaft 30. Coil spring 52 has a first lead end 56 that rests against surface 58 of bracket 18 between rib member 60. The second lead end 62 of coil spring 52 is inserted in and rests near the bottom of slot 50 in stub shaft 30. Similarly, coil spring 54 has a first lead end 64 that rests against surface 66 of bracket 16 between rib members 68. A second lead end 70 of coil spring 54 is inserted in and rests near the bottom of slot 50 of stub shaft 30. The first end leads 56 and 64 cooperate with bracket 18 and the second end leads 62 and 70 cooperate with frame 16 through stub shaft 30 to transmit a torsional force that is produced by coil spring 52 and 54 which urge the frame to the steady state location.

Springs 52 and 54 cooperate to position frame 16 in the steady state location as follows. Whenever frame 16 moves about vertical axis 20 along path 24 generally toward the left of FIG. 1, the first lead end 56 of coil spring 52 remains in contact with surface 58 to urge frame 16 back to its steady state location. Similarly, whenever frame 16 moves about pivotal axis 20 along path 24 generally toward the right in FIG. 1, first lead end 64 of coil spring 54 remains in contact with surface 66 to urge frame 16 back to its steady state location.

Bracket 18 includes a concave surface 72 that is disposed symmetrically about its midpoint along its length between lower end 38 and upper end 42. Concave surface 72 has an elongated slot 74 which receives an Allen-type screw 76. Screw 76 is inserted through slot 74 so that the head of the screw is positioned near frame 16. Screw 76 holds washer 78 with a convex surface 80 of complementary contour to that of concave surface 72. Screw 76 and washer 78 are positioned on the side of bracket 18 near frame 16.

An expansible mounting clip 82 includes a top surface 84 which has a hole 86 that receives that receives free end of screw 76. Mounting clip 82 is secured to screw 76 by a generally rectangular flat nut 88. Top surface 84 of mounting clip 82 is of concave contour which is complementary to that of the concave surface 72 of bracket 18. The above-described assembly of components secured together by screw 76 provides an adjustment means for positioning bracket 18 so that pivot access 20 can be adjusted to the desired vertical disposition.

Figure 5:
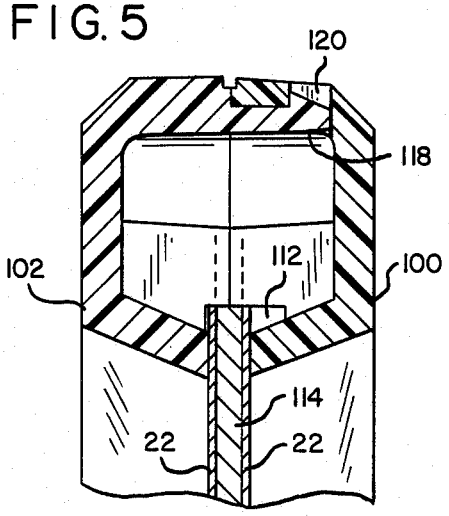
FIG. 5 is a sectional view taken along line 5—5 of FIG. 1.
Figure 6:
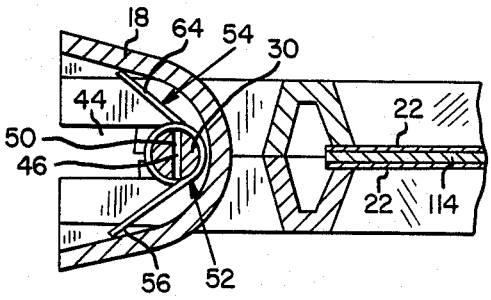
FIG. 6 is a sectional view taken along line 6—6 of FIG. 2.

With reference to FIGS. 4–6, frame 16 is comprised of first and second frame sections 100 and 102 that have complementary fastening means which fit together to assemble the frame. Frame sections 100 and 102 are of similar design. The parts of frame section 102 that correspond to those of frame section 100 are designated by identical reference numerals followed by primes.

First frame section 100 comprises a unitary piece of molded plastic that includes upper stub shaft 30. Frame section 100 is of generally rectangular shape with a top member 104, bottom member 106, first side member 108, and second side member 110. Top member 104 and bottom member 106 are preferably of about 19 cm in length, and side members 108 and 110 are preferably of about 11.5 cm in length. The side members define a planar viewing surface for the advertising message that appears on placards 22. The viewing surface is preferably about 15 cm in length and about 9 cm in width. Each one of the members of frame section 100 has a recessed area along the length of its inside surface to reduce the amount of plastic material and thereby decrease the weight of the frame. The inside surfaces of top member 104 and bottom member 106 have ribs 112 upon which the placards 22 rest when they are inserted into frame 16 after it has been assembled.

A metal plate 114 is positioned against ribs 112 before frame sections 100 and 102 are assembled. Metal plate 114 provides a rigid protective backing for two placards 22, which are placed against either one of the surfaces of the plate so that an object striking the area enclosed by the frame will not dislodge the placards from it. Three tab members 118 extend from each of the top and bottom members 104' and 106; of frame section 102 toward frame section 100. Tab members 118 fit into slots 120 in corresponding locations on frame section 100 to assemble frame 16. (Only four of slots 120 are shown in FIG. 4.)

Each one of sides 110 and 110' of the respective frame sections 100 and 102 has a respective cutout portion 122 and 124 that forms a slot when frame 16 is assembled. The slot is sufficiently wide to receive a single placard inserted into frame 16 from its free end on either side of metal plate 114 that is captured between a frame section and metal plate 114. An elongated end cap 126 has a pin 128 extending from each of its ends to fit against the upper and lower edges of the slot to close it and thereby keep the two placards 22 in place. Although end cap 126 is not constructed to prevent unauthorized access to the placards, its pins can be provided with locking tabs for engaging the frame sections, and it would then require a special tool, such as a small pin or lever to be inserted through an appropriate location in the frame section to deflect such locking tabs, to release them and allow the separation of end cap 126 from the remainder of the display apparatus. Other locking systems will become apparent to those skilled in the art upon studying the illustrated features of the present invention.

With reference to FIG. 2, shelf tag molding 12 is shown with expansible mounting clip 82 secured rigidly in it. Shelf tag molding 12 comprises a flat metal strip whose side margins 130 and 132 are turned toward each other to form a channel-shaped molding. Mounting clip 82 comprises a single rectangular strip of metal which is bent in two places near its center to form top surface 84 with a pair of flared-apart leg portions 134 and 136. The ends 138 and 140 of the respective leg portions 134 and 136 are bent away from each other and are adaptable to engage the inwardly-curved side margins of shelf tag molding 12. Expansible mounting clip 82 is secured to shelf tag molding 12 by fitting leg portions 134 and 136 against the back surface 142 of shelf tag molding 12, and tightening screw 76 so that, as nut 88 moves closer to washer 78, it exerts pressure against leg portions 134 and 136 so that they increasingly flare apart. Screw 76 is tightened until end portions 138 and 140 engage the respective side margins 130 and 132 of shelf tag molding 12 to secure display apparatus 10 to it. During the tightening operation, display apparatus 10 is held in the desired vertical disposition to accomplish at the same time an adjustment for orienting the placards at a desired angular disposition within the planar viewing surface.

With particular reference to FIG. 1, it will be appreciated that screw 76 fits completely within the recess formed by concave surface 72 of bracket 18. This promotes the quasi-permanent aspect of display apparatus 10 in that its removal requires the use of a special tool (for Allen-type screws) and frame 16 must be pivotally moved purposefully to gain access to screw 76 to remove display apparatus 10 from the shelf.

The above description is directed to an apparatus for displaying promotional material having numerous advantages as illustrated above. Promotional campaigns, in addition to advertising a new product, frequently offer printed material for the customer's use. This material could comprise, for example, rebates, refunds, suggested recipes or suggested uses for the product, amplified product descriptions and amplified directions for product use. In particular, manufacturers of several products offered for sale in a given store could present a variety of promotional material for such products, which presents a uniform visual image to the customer. For example, recipes for one food product could refer the customer to other ingredients offered nearby by the same manufacturer. A second display and dispensing apparatus could provide the customer with other recipes using other products by the manufacturer. To provide these advantages, a second embodiment of the present invention, illustrated in FIGS. 7–15, not only displays promotional material, but also dispenses it from a location immediately adjacent the products to be promoted.

Figure 7:
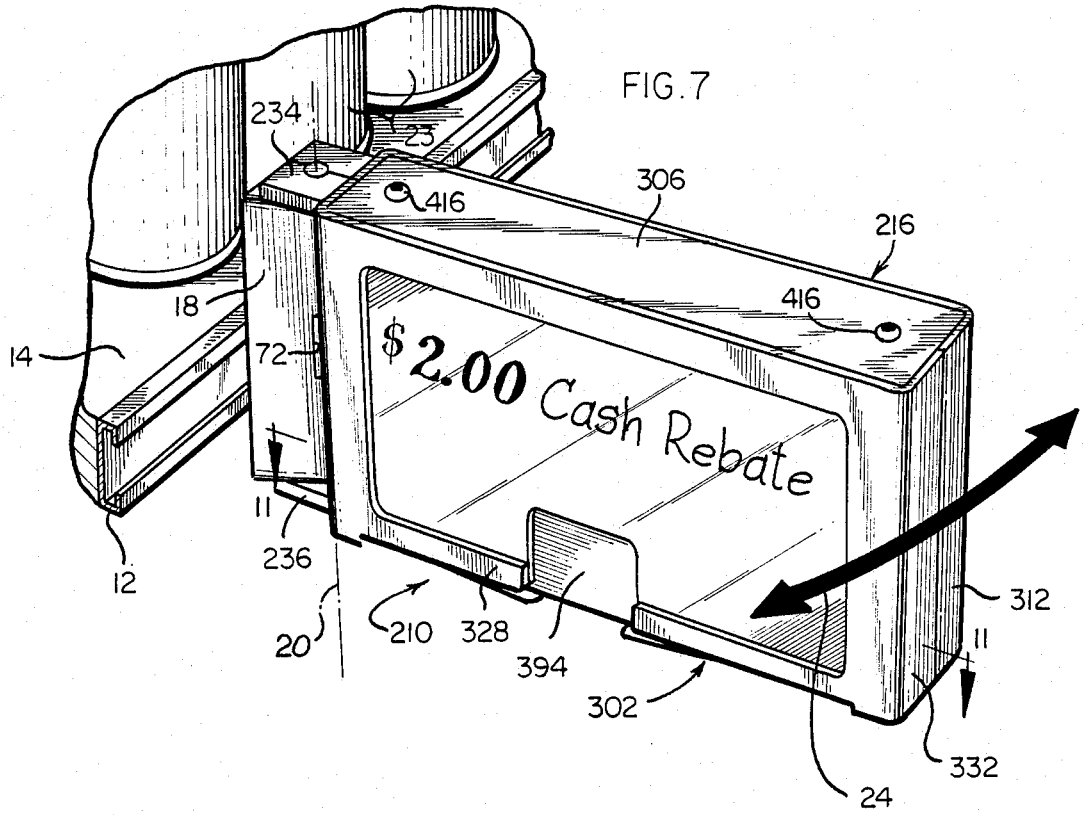
FIG. 7 is a perspective view showing a second illustrative apparatus mounted to shelf tag molding on the frontal margin of a shelf for displaying and dispensing promotional material that is positioned in the direct view of approaching customers, which embodies various features of the present invention.

With reference to FIG. 7, the display and dispensing apparatus 210 of the present invention is mounted to a strip of shelf tag molding 12 that is secured to the frontal margin of a shelf 14. Display and dispensing apparatus 210 comprises a frame 216 that is pivotably mounted to the same bracket assembly 18, as described above, which is rigidly secured to shelf tag molding 12. Bracket 18 is positioned on a shelf tag molding 12 so that frame 216 pivotably moves about a vertical pivot axis 20. Frame 216 displays and holds for dispensing from either one of its surfaces, promotional material, such as discount rebates. The display and dispensing apparatus 210 includes a biasing means or spring which positions frame 216 in a steady state location that is generally normal to shelf tag molding 12.

As in the previously described embodiment, the promotional material preferably calls a customer's attention to a product 23, which is shown in FIG. 7 as cans of cola, that can be found in the area on shelf 14 where display and dispensing apparatus 210 is mounted. In addition to displaying the promotional material, the embodiment 210 of the present invention also offers sheets of the material to the customer. Frame 216 is mounted to bracket 18 to pivotally move out of the way of a customer or shopping cart that strikes it. Whenever frame 216 is pivotally moved in a rotational sense along the arcuate path 24 as shown, the biasing means automatically returns frame 216 to its steady-state location. This ensures that the advertising message on the promotional material continually remains in direct view of approaching customers.

As will be seen, bracket 18 provides a mounting for apparatus 210 that functions very much as described above. Nonetheless, a description of the bracket and its mounting for apparatus 210 will be set forth in the following paragraphs. Similarities in the mounting portion of the two illustrated embodiments will become apparent upon studying the following description.

Figure 8:
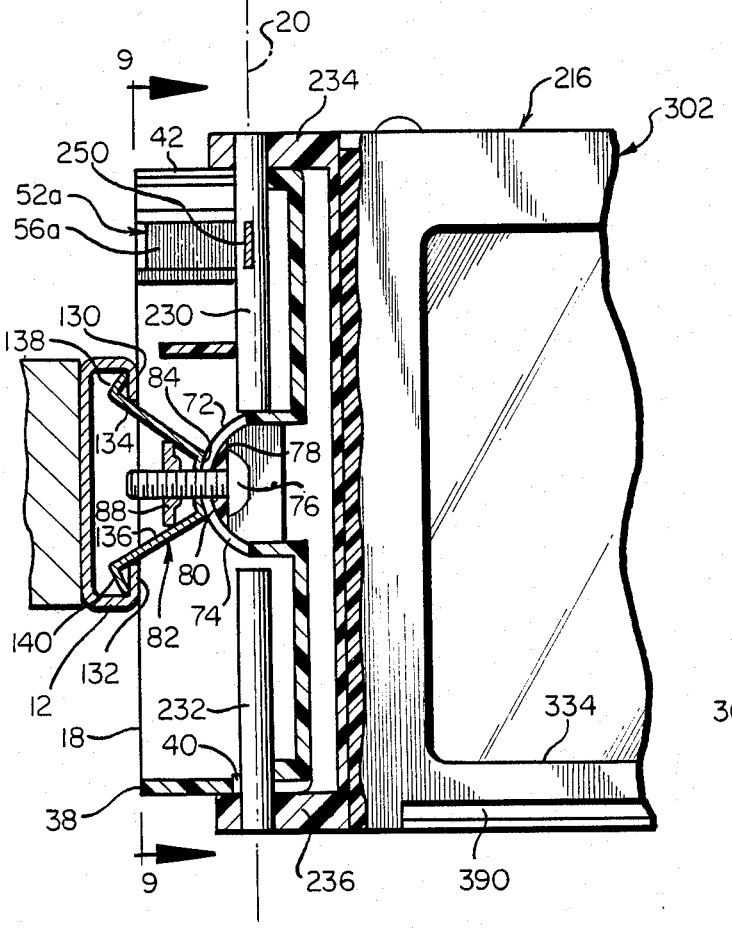
FIG. 8 is a fragmentary side elevational view of the display apparatus of FIG. 7 with portions cut away to show in detail the mounting bracket.
Figure 9:
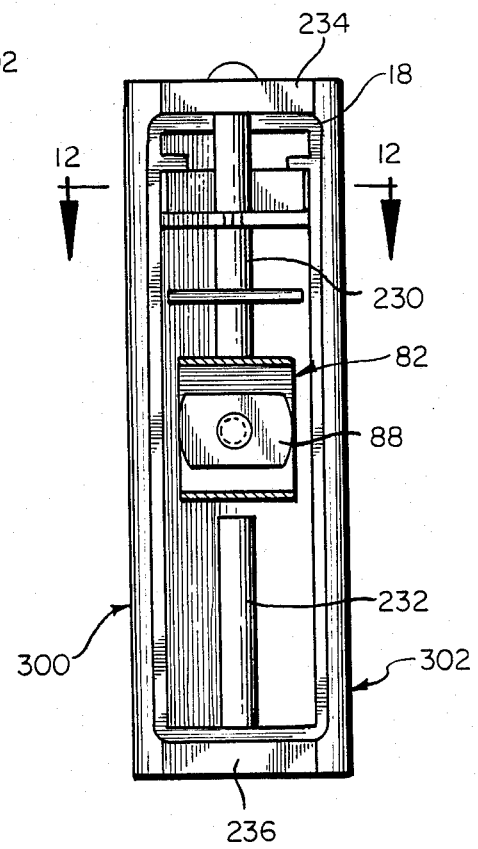
FIG. 9 is an end view looking at the interior of the mounting bracket along line 9—9 of FIG. 8 with a portion of the clip shown in cross-section.
Figure 10:
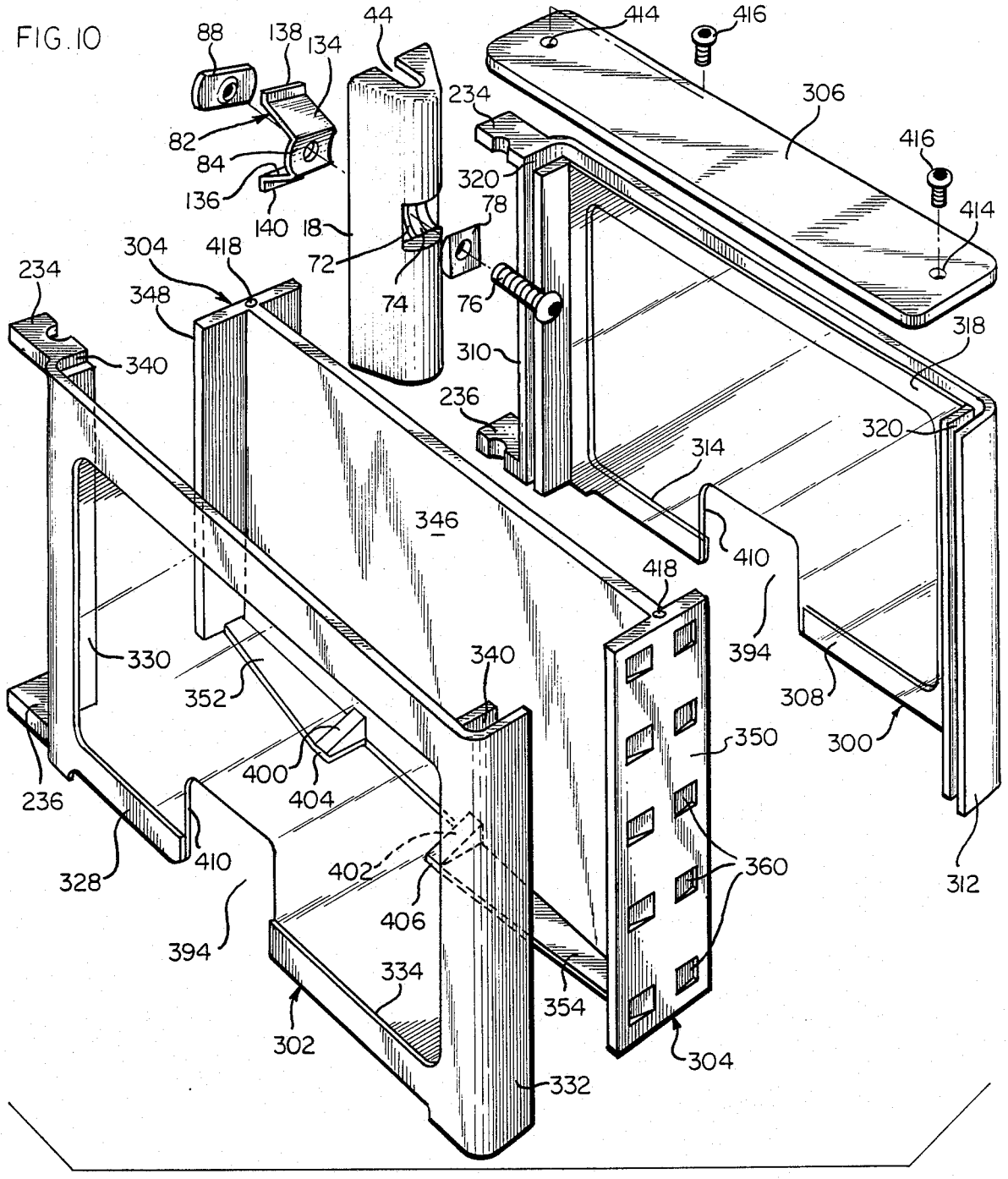
FIG. 10 is an exploded perspective view of the display and dispensing apparatus of FIG. 7.

With reference to FIGS. 8–10, bracket 18 is mounted for relative pivotal movement about a first or upper stub shaft 230 and a second or lower stub shaft 232. Upper stub shaft 230 projects downwardly from the upper extension 234 of frame 216, and lower stub shaft 232 extends upwardly from the lower extension 236 of frame 216. Bracket 18 is generally of V-shaped cross-section in the horizontal plane that is defined by shelf 14 in FIG. 7. The lower end 38 of bracket 18 has a hole 40 which receives lower stub shaft 232. The upper end 42 of bracket 18 has an open-ended elongated U-shaped slot 44 (FIG. 10) that receives upper stub shaft 230. A center 46 of the radius of curvature of slot 44 is axially aligned with the center of hole 40 to promote the pivotal movement of bracket 18 about stub shafts 230 and 232 relative to frame 216. The line connecting the centers defines pivot axis 20.

Bracket 18 is mounted to frame 216 by inserting stub shaft 232 into hole 40, orienting bracket 18 such that the sides of its U-shaped slot 44 are perpendicular to the surfaces of frame 216, and guide stub shaft 230 into slot 44.

Upper stub shaft 230 has an opening or a thin slot 250 within the upper one-half thereof which defines a plane that lies along pivot axis 20, as best seen in FIG. 8. A leaf spring **52*a* has its central portion inserted in and rests near the bottom of slot 250 in stub shaft 230. The leaf spring 52*a* performs the general function of the coil springs 52 and 54 of FIGS. 1–6 The leaf spring 52*a* has ends 56*a* and 64*a* which abut side walls of bracket 18 and urge the frame to the steady state location by transmitting a torsional force that is produced by distended leaf spring 52*a* which is applied to the frame 216 through stub shaft 230**.

Spring **52*a* thus functions to position frame 216 in the steady state location as follows. Whenever frame 216 moves about vertical axis 20 along path 24 generally toward the left in FIG. 7, i.e. clockwise as viewed from above in FIG. 12, the lead end 56*a* of spring 52*a* remains in contact with surface 58 while this half of the spring flexes and creates force to urge frame 216 back to its steady state location. Similarly, whenever frame 216 moves about pivotal axis 20 along path 24 generally toward the right in FIG. 7, lead end 64*a* of leaf spring 52*a* remains in contact with surface 66 to flex and similarly urge frame 216** back to its steady state location.

Bracket 18 includes a concave surface 72 that is disposed symmetrically about its midpoint along its length between lower end 38 and upper end 42. Concave surface 72 has an elongated slot 74 which receives an Allen-type screw 76. Screw 76 is inserted through slot 74 so that the head of the screw is positioned near frame 216. Screw 76 holds washer 78 with a convex surface 80 of complementary contour to that of concave surface 72. Screw 76 and washer 78 are positioned on the side of bracket 18 near frame 216.

An expansible mounting clip 82 includes a top surface 84 which has a hole 86 that receives free end of screw 76. Mounting clip 82 is secured to screw 76 by a generally rectangular flat nut 88. Top surface 84 of mounting clip 82 is of concave contour which is complementary to that of the concave surface 72 of bracket 18. The above-described assembly of components secured together by screw 76 provides an adjustment means for positioning bracket 216 so that pivot access 20 can be adjusted to the desired vertical disposition. As mentioned hereinafter, other suitable mounting means can be used in substitution for the clip 82 when the molding 12 is not utilized for mounting.

With reference to FIGS. 10–14, frame 16 is comprised of first and second frame sections 300, 302 and a central divider wall assembly 304. Frame sections 300, 302 are mirror images of each other, having a generally U-shaped cross-section in plan view. As shown in the illustrated embodiment of FIG. 10, frame sections 300, 302 are attached to divider wall assembly 304 with a snap fit and, along with a removable cover plate 306, form the completed frame 216.

First frame section 300 comprises a unitary piece of molded plastic that includes a side wall 308 intermediate inner and outer end walls 310, 312, respectively. Side wall 308 defines a central opening or window 314 for displaying promotional material contained within frame 216. The first frame section 300 further includes a bottom wall and an opposed upper cover-receiving opening 318. Inner end wall 310 carries upper and lower extensions 234, 236 which in turn provide mounting of the stub shafts 30, 32, respectively. Inner and outer end walls 310, 312 each include pockets 320 for receiving stub walls of divider wall assembly 304.

The second frame section 302 has a configuration similar to its mirror image frame section 300, and includes a side wall 328 intermediate an inside end wall 330 and an outside end wall 332. Side wall 328 defines an opening or window 334 for displaying promotional material. The end walls 330, 332 of second frame section 302 also define pockets 340 which provide a snap fit with divider wall assembly 304.

Referring especially to FIG. 10, divider wall assembly 304 includes a center wall 346 joined at each end to stub walls 348, 350 to form a generally H-configuration in plan cross-section. Divider wall assembly 304 further includes generally triangular-shaped bottom walls 352, 354 which provide substantial closure of the bottom portion of frame 216. Bottom walls 352, 354 are continuously joined with the bottom edge of center wall 346.

Stub walls 348, 350 include teeth engaging pockets 360 which engage tooth-like projections 362 on the inside surfaces of pockets 320, providing a secure frictioned engagement, securely joining frame sections 300, 302 with divider wall assembly 304. Other arrangements for joining frame sections with the divider wall assembly without glue, sonic welding, or the like adhesive, are possible. For example, stub walls 348, 350 could be provided with outwardly projecting resilient tabs receivable in locking windows and in end walls 310, 312.

Figure 11:
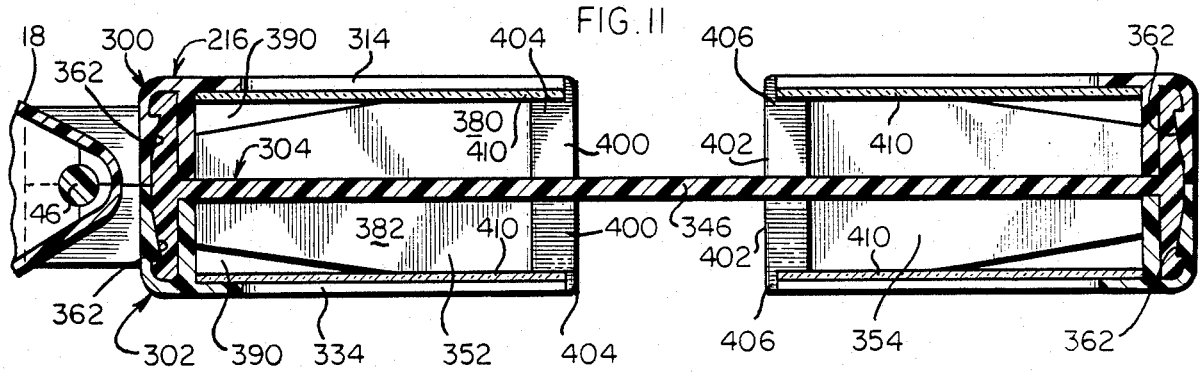
FIG. 11 is a sectional view of the empty display and dispensing apparatus of FIG. 7 taken along line 11—11 looking in the direction of the arrows.
Figure 12:
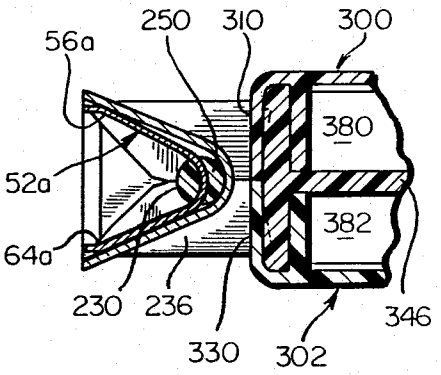
FIG. 12 is a sectional view taken along line 12—12 of FIG. 9.
Figure 15:
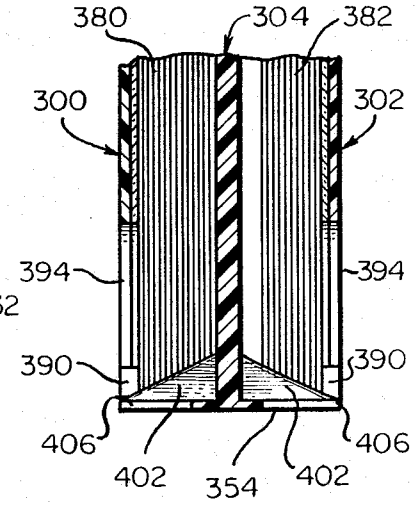
FIG. 15 is a fragmentary sectional view taken along line 15—15 of FIG. 13.
Figure 13:
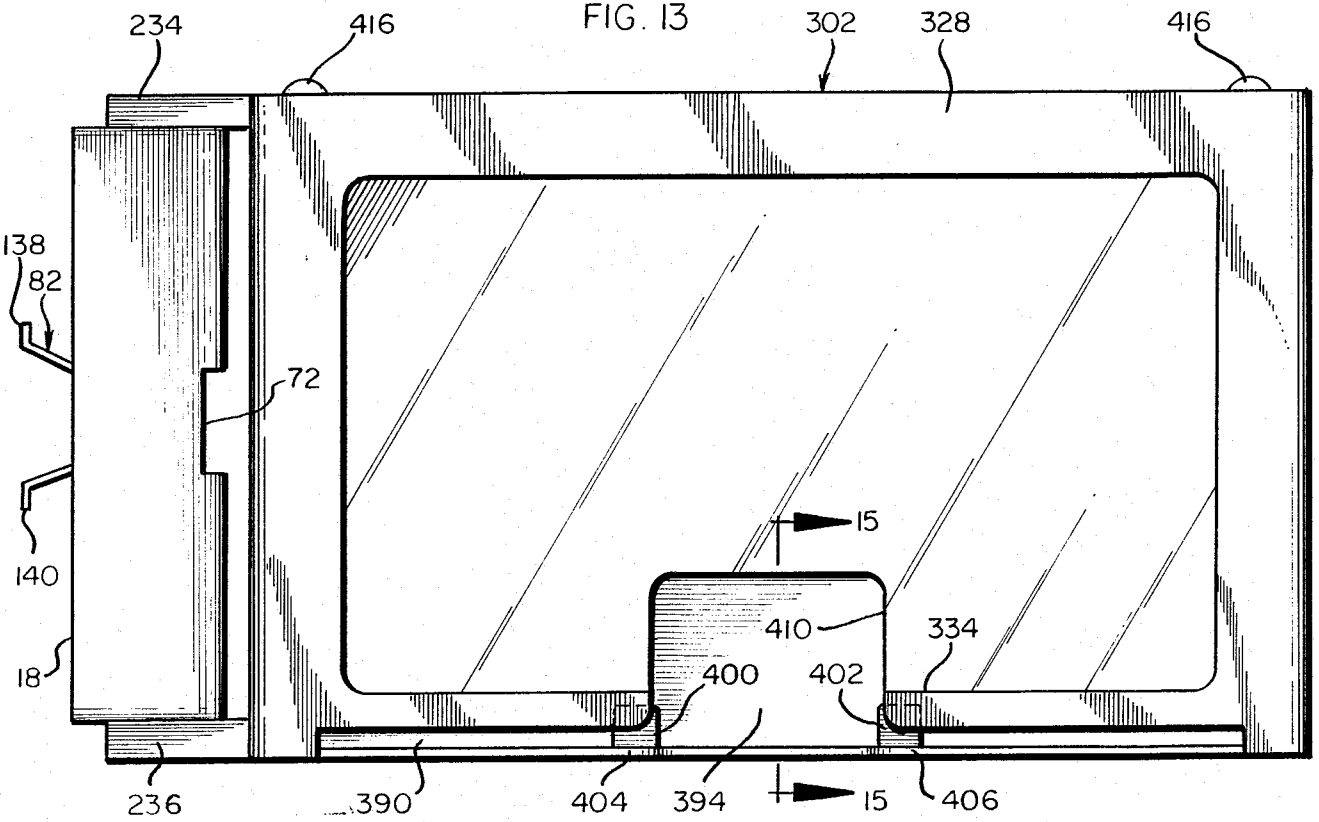
FIG. 13 is a side elevational view of the empty display and dispensing apparatus of FIG. 7.
Figure 14:
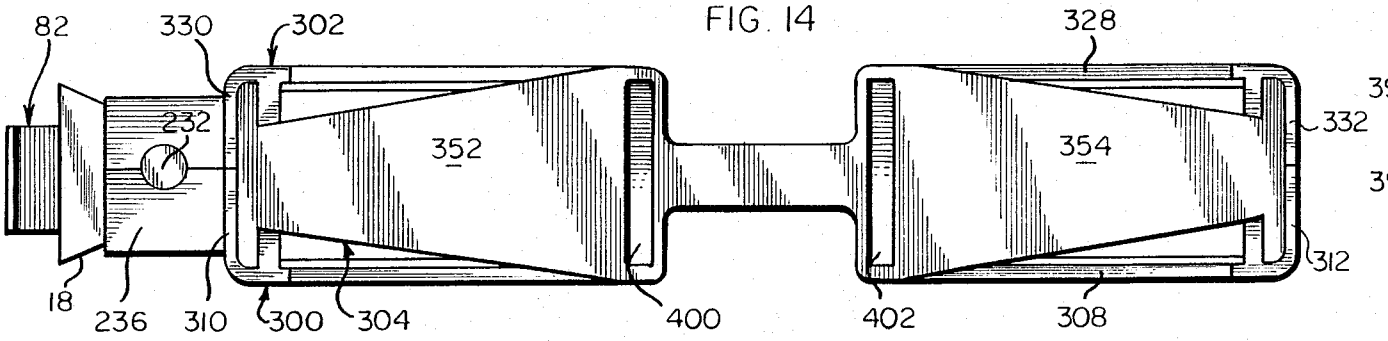
FIG. 14 is a bottom view of the display and dispensing apparatus of FIGS. 7–13.

With reference to FIG. 11, it can be seen that the center wall 346 divides the interior of the frame into two cavities 380, 382 with major surfaces **346*a*, 346*b*** enclosing interior portions of the cavities. Each cavity 380, 382 holds a plurality of sheets of promotional material with the first sheet of each plurality displayed for viewing through windows 314, 334. To facilitate dispensing of the first sheet of each plurality, side walls 308, 328 are not joined to triangular bottom walls 352, 354 but are spaced apart therefrom to form dispensing slots 390. As seen most clearly in FIGS. 7 and 10, side walls 308, 328 have finger-receiving openings 394 communicating with dispensing slots 390 to allow an observer to reach into one of the material-storing cavities 380, 382 to manually grasp and withdraw the outer sheet from either cavity. To facilitate dispensing, inclined ridges 400, 402 are formed adjacent the interior opposed edges of triangular walls 352, 354, adjacent dispensing slots 390. At the point where the ridges meet center wall 346, they are of maximum height, (see FIG. 15) and taper to minimal height at their outer portions 404, 406, at the juncture of dispensing slots 390 and finger-receiving openings 394. To assist in defining finger-receiving opening 394, and to help retain promotional material within cavities 380, 382, windows 314, 334 can be covered with a clear, transparent sheet material 410 such as plastic. Removable cover plate 306 provides ready access through a wide upper slot or aperture, which is otherwise open, for bulk loading of materials into cavities 380, 382 and is preferably secured as discussed hereinafter.

With reference to FIG. 8, shelf tag molding 12 is shown with expansible mounting clip 82 secured rigidly in it. Shelf tag molding 12 comprises a flat metal strip whose side margins 130 and 132 are turned toward each other to form a channel-shaped molding. Mounting clip 82 comprises a single rectangular strip of metal which is bent in two places near its center to form top surface 84 with a pair of flared-apart leg portions 134 and 136. The ends 138 and 140 of respective leg portions 134 and 136 are bent away from each other and are adaptable to engage the inwardly-curved side margins of shelf tag molding 12. Expansible mounting clip 82 is secured to shelf tag molding 12 by fitting leg portions 134 and 136 against the back surface 142 of shelf tag molding 12, and tightening screw 76 so that, as nut 88 moves closer to washer 78, it exerts pressure against leg portions 134 and 136 so that they increasingly flare apart. Set screw 76 is tightened until end portions 138 and 140 engage the respective side margins 130 and 132 of shelf tag molding 12 to secure display apparatus 10 to it. During the tightening operation, display apparatus 10 is held in the desired vertical position to accomplish at the same time an adjustment for orienting the advertising material at a desired angular disposition within the planar viewing surface.

With particular reference to FIG. 7, it will be appreciated that screw 76 fits completely within the recess formed by concave surface 72 of bracket 18. This promotes a semipermanent aspect of display and dispensing apparatus 10, in that its removal requires the use of a special tool (Allen-type wrench), and frame 16 must be pivotally moved purposefully to gain access to screw 76 to remove display apparatus 10 from the shelf.

The cover plate 306 is preferably provided with a pair of apertures 414 which will accommodate two locking fasteners 416, such as Allen-head screws, each of which has a hexagonal socket in its head and thus can only be turned by use of a special Allen-head wrench. The screws 416 are received in threaded holes 418 which are drilled or otherwise suitably formed in the divider wall assembly 304 as best seen in FIG. 10. By using such an arrangement, only a person having an Allen-head wrench of the appropriate size would be able to quickly remove the screws 416 to obtain access to the cavities. This arrangement allows an authorized person to easily fill the cavities with the intended sheets of promotional material, then replace the cover plate 306 and secure it in the closed position, while preventing easy access by a casual tamperer or competitor.

Although the preferred embodiments illustrating the invention, which constitute the best mode presently known to the inventors for carrying out their invention, have been described hereinabove, changes and modifications as would be obvious to those having the ordinary skill in this art may be made without deviating from the scope of the invention which is defined by the claims appended hereto. For example, instead of using the illustrated mounting clip, which is designed to attach to the facing flanges of a price channel or shelf tag molding, other suitable mounting devices can be used for releasably mounting such display apparatus to other structural members for holding a stock of products for sale. For example, screw type clamp brackets, such as are known in the art and resemble the commonly available C-clamps, can be used to support the apparatus from a horizontal shelf, and such brackets can be constructed so as to be operative to secure the apparatus to either a relatively thick shelf or to a shelf of a substantially thinner dimension having a depending front flange. Particular features of the invention are emphasized in the claims which follow.

What is claimed is:

1. A self-aligning apparatus for displaying sheets of promotional material to observers approaching from generally opposite directions, comprising:

frame means defining sheet-receiving cavity means;

said frame means including front and rear walls having transparent sheet-like window means for displaying, in opposed directions, promotional material received in said cavity means;

said frame means further including intermediate wall means extending between said front and said rear walls and cooperating therewith and with the sheet-like window means to substantially enclose said cavity means and sheets of promotional material received therewithin;

material transfer means for moving sheets of promotional material into and out of said cavity means including slot means formed in said intermediate wall means dimensioned so as to permit the passage of said promotional material sheets therethrough without flexing; and bracket means for securing the frame means to a support structure, the frame means being pivotably movable relative to the bracket means.

2. The apparatus of claim 1 further comprising biasing means operatively connected to the bracket means for urging the frame means to a steady-state location that places the promotional material into the observer's direct view, the biasing means being operable to return the frame means to the steady state location whenever the frame means is pivotably moved from it, to thereby ensure that the promotional material continually remains in the direct view of approaching observers.

3. The apparatus of claim 1 wherein said frame includes a divider wall which separates said cavity means into two opposed cavities and includes at least one slot means communicating with each cavity for inserting and removing promotional material sheeting with respect thereto, said slot means comprising said material transfer means.

4. The apparatus of claim 3 wherein said frame defines a single slot means for inserting and removing promotional material into and out of both said cavities.

5. The apparatus of claim 3 wherein said cavities each hold plural sheets of said promotional material and said frame defines a first slot means for bulk loading said promotional material into said cavities and a second slot means for dispensing individual sheets from at least one of said cavities.

6. A self- aligning apparatus for displaying promotional material to observers approaching from generally opposite directions, comprising:

frame means defining promotional material-receiving cavity means and including front and rear walls having window means for displaying, in opposed directions, plural sheets of promotional material received in said cavity means, and a divider wall which separates said cavity means into two opposed cavities;

said frame means further including wall means extending between said front and said rear walls and cooperating therewith to substantially enclose said cavity means;

material transfer means for moving promotional material into and out of said cavity means, said material transfer means comprising first and second slot means defined by said frame means and communicating with each cavity said first slot means for bulk loading said promotional material sheeting into said cavities and said second slot means for dispensing individual sheets from at least one of said cavities; and bracket means for securing the frame means to a support structure, the frame means being pivotably movable relative of the bracket.

7. The apparatus of claim 6 wherein said wall means includes opposed top and bottom walls, one of which defines said first slot means including a removably covered aperture for bulk loading of promotional material in said one cavity and the other of which defines said second slot means.

8. The apparatus of claim 7 wherein said top wall defines said removably covered aperture and said bottom wall defines said second slot means operable to dispense individual sheets of promotional material from said one cavity.

9. The apparatus of claim 6 wherein said slot means are formed at the juncture of said bottom wall with one of said front and said rear walls.

10. The apparatus of claim 9 wherein said one of said front and said rear walls defines a finger receiving opening extending into said slot means to allow an observer to manually grasp at least one sheet of said promotional material for extraction from said cavity.

11. The apparatus of claim 10 wherein said bottom wall defines inclined ridge means extending from said slot means toward said divider wall to guide said promotional material toward said slot means, thereby aiding in the dispensing thereof from said one cavity.

12. A self-aligning display apparatus, comprising:

a frame that is adaptable to carry at least one sheet of promotional material for display to approaching observers, the frame being adaptable to carry a plurality of the sheets of promotional material and defining a first aperture for bulk loading of the sheets and a second aperture for dispensing individual ones of the sheets to approaching observers;

bracket means for securing the frame to a support structure, the frame being pivotally movable relative to the bracket means; and biasing means operatively connected to the bracket means for urging the frame to a steady state location that places the promotional material into the observer's direct view, the biasing means being operable to return the promotional material to the steady state location whenever the frame is pivotally moved from it, thereby to ensure that the promotional material continually remains in the direct view of the approaching observers.

13. The apparatus of claim 12 in which the frame has side members that define a planar viewing surface, and the bracket means further comprises adjustment means for adjustably positioning the frame so that the promotional material can be oriented at a desired angular disposition within the planar viewing surface.

14. The apparatus of claim 12 in which the frame and the bracket means are connected for pivotal movement about a shaft, and the urging means comprises a coil spring that encircles at least a portion of the shaft and has first and second end leads, the first end lead cooperating with the bracket means and the second end lead cooperating with the frame to transmit a torsional force produced by the coil spring that urges the frame to the steady state location

15. The apparatus of claim 14 in which the shaft is rigidly connected to the frame and has an opening which receives the second end lead to transmit the torsional force.

16. The apparatus of claim 12 in which the support structure comprises a shelf having a frontal margin that includes a channel-shaped molding with first and second side margins that are turned toward each other, and the bracket means further comprises a compressible mounting clip with first and second end portions that are turned away from each other and are adaptable to engage the side margins of the molding and thereby secure the apparatus to the support structure.

17. A method of directing customer attention to a featured item in a store as customers approach the area of a shelf on which the item can be found, comprising:

pivotally mounting to the shelf a frame that carries promotional material which presents an advertising message about the item, the frame being adaptable for the replacement of the promotional material by a different promotional material with a different advertising message;

providing a cavity in the frame for retaining plural sheets of promotional material;

providing a first access to the cavity for bulk loading of plural sheets of promotional material therein;

providing the customer with a second access to the cavity for withdrawing at least individual sheets of the promotional material;

positioning the frame so that it is operable for pivotal movement about a substantially vertical axis; and biasing the frame to urge it to a steady state location in which the promotional material projects outwardly from the frontal margin of the shelf into the direct view of the approaching customers and to return the promotional material to the steady state location whenever the frame is pivotally moved from it, thereby to ensure that the promotional material continually remains in the direct view of the approaching customers.

18. The method of claim 17 which further comprises:

providing a shelf having shelf tag molding mounted on its frontal margin; and pivotally mounting the frame to the shelf tag molding.

* * * * *